US009777738B2

(12) United States Patent
Chen et al.

(10) Patent No.: US 9,777,738 B2
(45) Date of Patent: Oct. 3, 2017

(54) ANTI-AIR-RETURN SYSTEM AND METHOD OF FAN

(71) Applicant: DELTA ELECTRONICS, INC., Taoyuan Hsien (TW)

(72) Inventors: Jung-Yuan Chen, Taoyuan Hsien (TW); Yen-Hung Chen, Taoyuan Hsien (TW); Ching-Sen Hsieh, Taoyuan Hsien (TW); Yueh-Hsin Liu, Taoyuan Hsien (TW); Chen-Chien Kao, Taoyuan Hsien (TW); Shih-Yuan Chiang, Taoyuan Hsien (TW); Jian-Cun Lin, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 384 days.

(21) Appl. No.: 14/290,496

(22) Filed: May 29, 2014

(65) Prior Publication Data

US 2015/0152876 A1 Jun. 4, 2015

(30) Foreign Application Priority Data

Nov. 29, 2013 (CN) ..... 2013 1 0638549

(51) Int. Cl.
*F04D 27/00* (2006.01)
*F04D 25/06* (2006.01)

(52) U.S. Cl.
CPC ..... *F04D 27/008* (2013.01); *F04D 25/06* (2013.01); *F04D 27/001* (2013.01); *F04D 27/004* (2013.01)

(58) Field of Classification Search
CPC ..... F04D 27/008; F04D 25/06; F04D 27/001; F04D 27/004; F04D 25/08; F04D 27/0292; F04D 27/01; F05D 2270/335; H02H 7/0844; H02H 7/093; H02P 1/04; H02P 6/06; H05K 7/20209
See application file for complete search history.

(56) References Cited

U.S. PATENT DOCUMENTS

| | | | | |
|---|---|---|---|---|
| 5,721,486 A * | 2/1998 | Pape | G01B 7/30 324/103 P |
| 2007/0145920 A1* | 6/2007 | Wu | F04D 25/16 318/268 |
| 2008/0048598 A1* | 2/2008 | Shibuya | H02P 6/185 318/400.1 |
| 2008/0100239 A1* | 5/2008 | Hsieh | F04D 25/08 318/268 |

FOREIGN PATENT DOCUMENTS

| | | |
|---|---|---|
| CN | 101127502 A | 2/2008 |
| CN | 201608680 U | 10/2010 |

* cited by examiner

*Primary Examiner* — Devon Kramer
*Assistant Examiner* — Thomas Cash
(74) *Attorney, Agent, or Firm* — Muncy, Geissler, Olds & Lowe, P.C.

(57) ABSTRACT

An anti-air-return fan system includes a motor, a driving control circuit, and a rotation judgment circuit. The driving control circuit is electrically connected to the motor. The driving control circuit has a driving signal for driving the motor to rotate according to the driving signal. The rotation judgment circuit outputs a judgment signal to the driving control circuit when detecting that the motor reversely rotate. The driving control circuit executes a braking according to the judgment signal. The driving control circuit drives the motor to operate when the rotation judgment circuit detects that the motor doesn't rotate reversely.

13 Claims, 13 Drawing Sheets

| rotating direction of motor | sensing signal S3a | sensing signal S3b | judgment signal S2 |
|---|---|---|---|
| clockwise | from low level to high level | low level | low level |
| counterclockwise | from low level to high level | high level | high level |

FIG.3

ANTI-AIR-RETURN SYSTEM AND METHOD OF FAN

CROSS REFERENCE TO RELATED APPLICATIONS

This Non-provisional application claims priority under 35 U.S.C. §119(a) on Patent Application No(s). 201310638549.9 filed in People's Republic of China on Nov. 29, 2013, the entire contents of which are hereby incorporated by reference.

BACKGROUND OF THE INVENTION

Field of Invention

The invention relates to a fan system and, in particular, to an anti-air-return system and method of fan.

Related Art

With the progress of technologies, the efficiency of an electronic device is increasingly enhanced. However, if the heat generated by the electronic device can't be dissipated properly, the efficiency of the electronic device will be lowered down and the electronic device may be even damaged. Therefore, a heat-dissipating device becomes an indispensible appliance for the electronic device.

Generally, the environment to which a heat-dissipating fan is applied is not always a free flow field. If the heat-dissipating fan is used under the condition of back pressure, it may be forced into a reverse rotation due to the generation of return air. Hence, the heat-dissipating fan can't operate normally, thereby losing the heat-dissipating function.

SUMMARY OF THE INVENTION

In view of the foregoing subject, an objective of the invention is to provide an anti-air-return system and method of fan so that the fan can be applied to the environment of return air.

To achieve the above objective, the anti-air-return fan system according to the invention includes a motor, a driving control circuit and a rotation judgment circuit. The driving control circuit is electrically connected to the motor. The driving control circuit has a driving signal for driving the motor to rotate. The rotation judgment circuit outputs a judgment signal to the driving control circuit when detecting that the motor reversely rotate. The driving control circuit executes a braking according to the judgment signal. The driving control circuit drives the motor to operate when the rotation judgment circuit detects that the motor doesn't rotate reversely.

In one embodiment, the driving control circuit executes the braking by fixedly enabling the corresponding switches according to the judgment signal.

In one embodiment, the driving control circuit delays the driving signal according to the judgment signal to execute the electromagnetic braking.

In one embodiment, the driving control circuit is a half-bridge circuit or a full-bridge circuit, and includes a plurality of switches.

In one embodiment, the driving control circuit executes the braking by fixedly enabling the corresponding switches.

In one embodiment, the rotation judgment circuit comprises a judgment module and at least two Hall elements. The Hall elements are electrically connected to the judgment module. Each of the Hall elements outputs a sensing signal to the judgment module according to the rotation of the motor, and the judgment module outputs the judgment signal to the driving control circuit according to the sensing signals.

In one embodiment, each of the Hall elements is connected to a resistor and a capacitor in series, and connected to the judgment module in parallel.

In one embodiment, the judgment module is a logic circuit or a microprocessor.

In one embodiment, the rotation judgment circuit detects if the rotational direction of the motor is reverse by a terminal voltage comparison estimation method, a third harmonic method, or a free-wheeling diode enabling estimation method.

To achieve the above objective, an anti-air-return method of a fan is disclosed, wherein the fan includes a motor, a rotation judgment circuit, and a driving control circuit having a driving signal and driving the motor to rotate according to the driving signal. The method comprises the steps of detecting whether an initial state of the fan is an operation state or a standby state; detecting if the rotational direction of the motor is reverse by the rotation judgment circuit; executing a braking by the driving control circuit according to a judgment signal outputted by the rotation judgment circuit when the rotational direction of the motor is reverse; and driving the motor to rotate by the driving control circuit when the rotational direction of the motor is not reverse.

In one embodiment, the driving control circuit executes the braking by fixedly enabling the corresponding switches according to the judgment signal.

In one embodiment, the driving control circuit delays the driving signal according to the judgment signal to execute the electromagnetic braking.

In one embodiment, after executing the braking, the method further comprises a step of increasing a working current of the motor if the rotation judgment circuit detects that the motor is still in reverse rotation, wherein the working current passes through a coil of the motor to generate a magnetic field.

In one embodiment, before increasing the working current, the method further comprises steps of detecting if the working current is greater than a predetermined value by the driving control circuit, and generating an alarm signal by the fan if the working current is greater than the predetermined value.

In one embodiment, the rotation judgment circuit comprises a judgment module and at least two Hall elements. The Hall elements are electrically connected to the judgment module. Each of the Hall elements outputs a sensing signal to the judgment module according to the rotation of the motor, and the judgment module outputs the judgment signal to the driving control circuit according to the sensing signals.

In one embodiment, the judgment module is a logic circuit or a microprocessor.

As mentioned above, in the anti-air-return system and method of the fan according to the invention, the rotation judgment circuit detects if the motor is in the reverse rotation. When the motor is in the reverse rotation, the rotation judgment circuit makes the driving control circuit execute the braking so that the motor can be turned into the normal rotation for a smooth operation.

BRIEF DESCRIPTION OF THE DRAWINGS

The invention will become more fully understood from the detailed description and accompanying drawings, which are given for illustration only, and thus are not limitative of the present invention, and wherein:

FIG. 3 is a judgment truth table of the judgment module;

DETAILED DESCRIPTION OF THE INVENTION

The present invention will be apparent from the following detailed description, which proceeds with reference to the accompanying drawings, wherein the same references relate to the same elements.

Figure 1A:
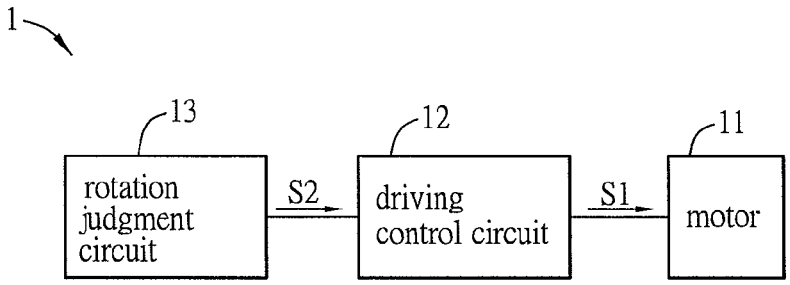
FIGS. 1A and 1B are block diagrams of an anti-air-return fan system according to an embodiment of the invention.

FIG. 1A is a schematic block diagram of an anti-air-return fan system according to an embodiment of the invention. As shown in FIG. 1, the anti-air-return fan system 1 includes a motor 11, a driving control circuit 12 and a rotation judgment circuit 13. In this embodiment, the motor 11 is connected to a fan to drive the impeller to rotate. The motor 11 can be a single-phase motor or a three-phase motor. The driving control circuit 12 is electrically connected to the motor 11. The driving control circuit 12 has a driving signal S1 for driving the motor 11 to rotate. The rotation judgment circuit 13 outputs a judgment signal S2 to the driving control circuit 12 when detecting that the motor 11 reversely rotate, and the driving control circuit 12 executes a braking according to the judgment signal S2. The driving control circuit drives the motor 11 to operate when the rotation judgment circuit 13 detects that the motor 11 doesn't rotate reversely. In other words, the motor 11 is turned into a non-reverse rotation, such as a stationary state or a normal rotation, by the braking from a reverse rotation, and therefore the motor 11 can operate according to a desired direction to overcome the reverse rotation caused by the return air.

Figure 1B:
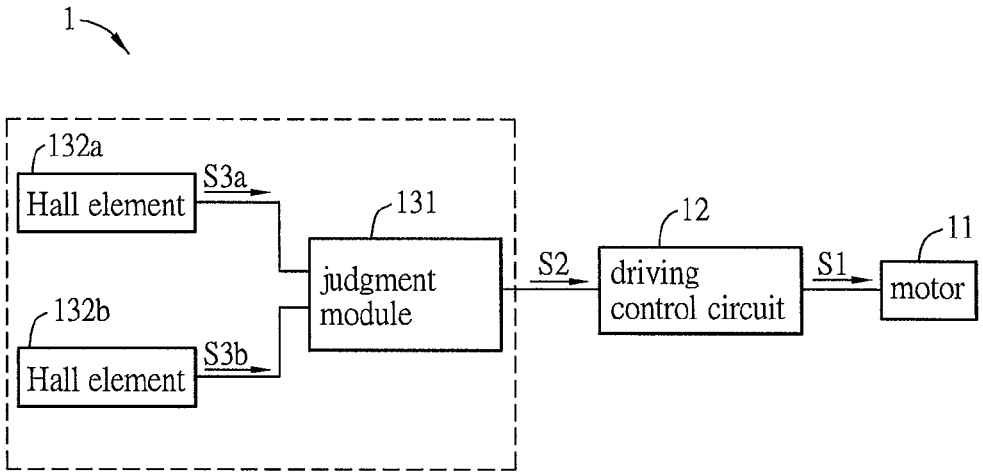

FIG. 1B is another block diagram of an anti-air-return fan system according to an embodiment of the invention. In this embodiment, the rotation judgment circuit 13 includes a judgment module 131 and at least two Hall elements 132*a*, 132*b*. The Hall elements 132*a*, 132*b* are electrically connected to the judgment module 131 and output sensing signals S3*a*, S3*b* to the judgment module 131 according to the rotation of the motor 11. The judgment module 131 outputs the judgment signal S2 to the driving control circuit 12 according to the sensing signals S3*a*, S3*b*. In detail, the Hall element 132 can convert a varied magnetic field into an electric signal. Thus, when the rotor of the motor 11 rotates to a sensing location of the Hall element 132*a*, 132*b* during the operation of the motor 11, the Hall element 132*a*, 132*b* can sense the magnetic pole of the rotor to output the sensing signal S3*a*, S3*b*, such as a high-level signal.

Figure 2A:
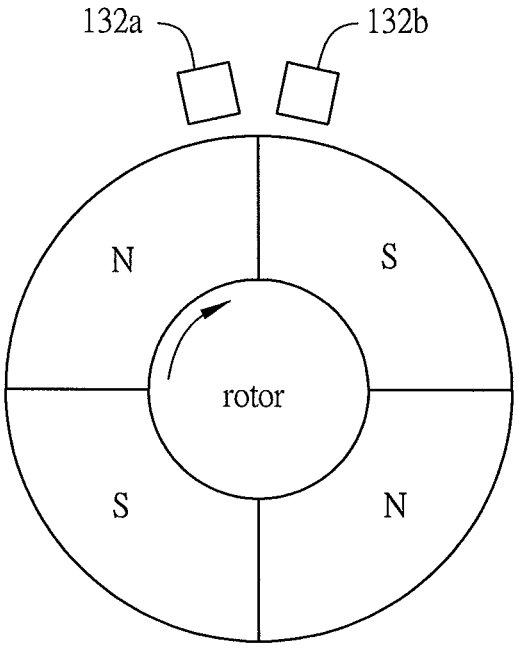
FIG. 2A is a schematic diagram of a Hall element and a rotor.

FIG. 2A is a schematic diagram of a Hall element and a rotor. As shown in FIGS. 1B and 2A, two Hall elements 132*a*, 132*b* are used to be electrically connected to the judgment module 131. In this embodiment, when sensing the N pole, the Hall elements 132*a*, 132*b* output high-level signals, and the clockwise direction shown in the figure is regarded as the normal rotation, for example. However, the direction of the normal or reverse rotation can be defined according to the practical application, and the invention is not limited thereto. As shown in FIG. 2A, when the rotor rotates along the arrowhead direction (clockwise direction), the N pole will sequentially pass through the Hall elements 132*a* and 132*b*. Accordingly, the Hall element 132*a* will first sense the N pole to output the high-level signal earlier, and then the Hall element 132*b* will sense the N pole to output the high-level signal later. Hence, the rotational direction of the motor 11 can be determined by the time difference between the outputs of the sensing signals S3*a* and S3*b* outputted by the Hall elements 132*a*, 132*b*.

Figure 2B:
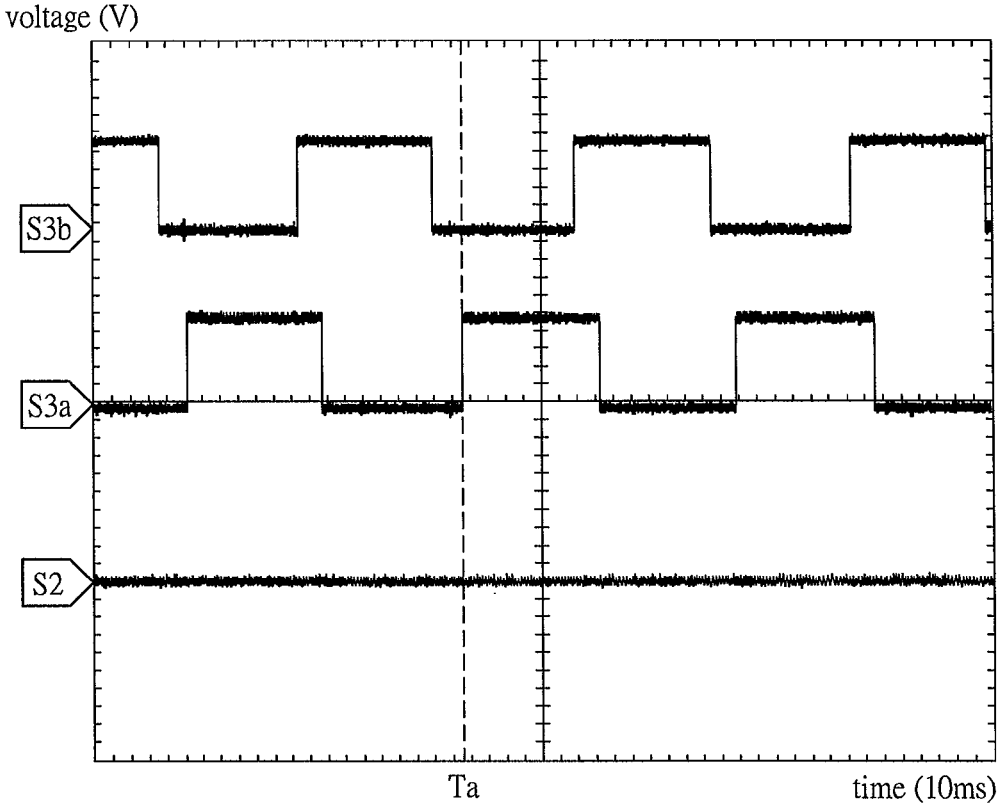
FIG. 2B is a schematic diagram of the signal waveform of the sensing signal and the judgment signal during the normal rotation of the motor.

FIG. 2B is a schematic diagram of the signal waveform of the sensing signal and the judgment signal during the normal rotation of the motor, and FIG. 3 is a judgment truth table of the judgment module 131. As shown in FIGS. 2A, 2B and 3, the judgment module 131 regards the sensing signal S3*a* of the Hall element 132*a* as a judgment reference. At the time Ta that the Hall element 132*a* senses the N pole to output the high-level signal, the Hall element 132*b* is in the state of low-level signal since the Hall element 132*b* doesn't sense the N pole not to output the sensing signal S3*b*. According to the specification of the truth table in FIG. 3, the judgment signal S2 outputted by the judgment module 131 is the low-level signal. Herein, since the judgment signal S2 is the low-level signal (which indicates that the signal is not outputted to the driving control circuit 12), the motor 11 remains the normal rotation.

Figure 4A:
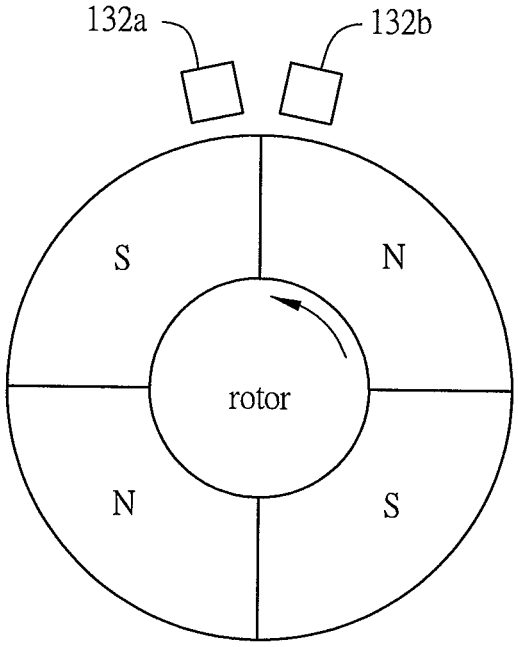
FIG. 4A is another schematic diagram of the Hall element and the rotor.
Figure 4B:
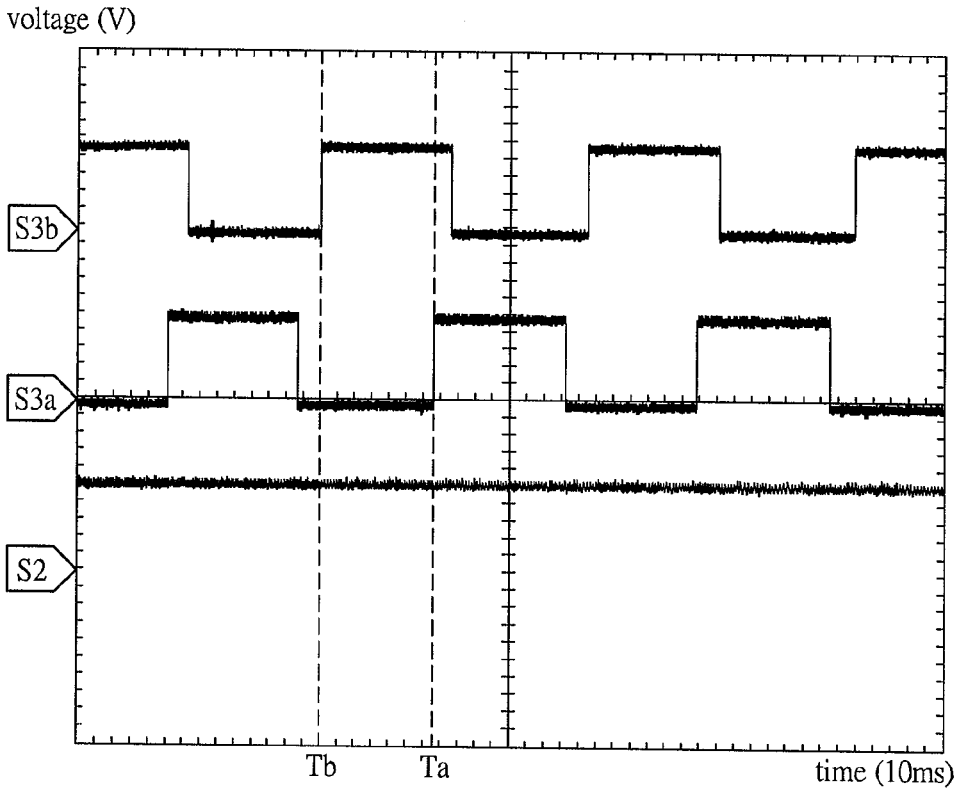
FIG. 4B is a schematic diagram of the signal waveform of the sensing signal and the judgment signal during the reverse rotation of the motor.
Figure 5:
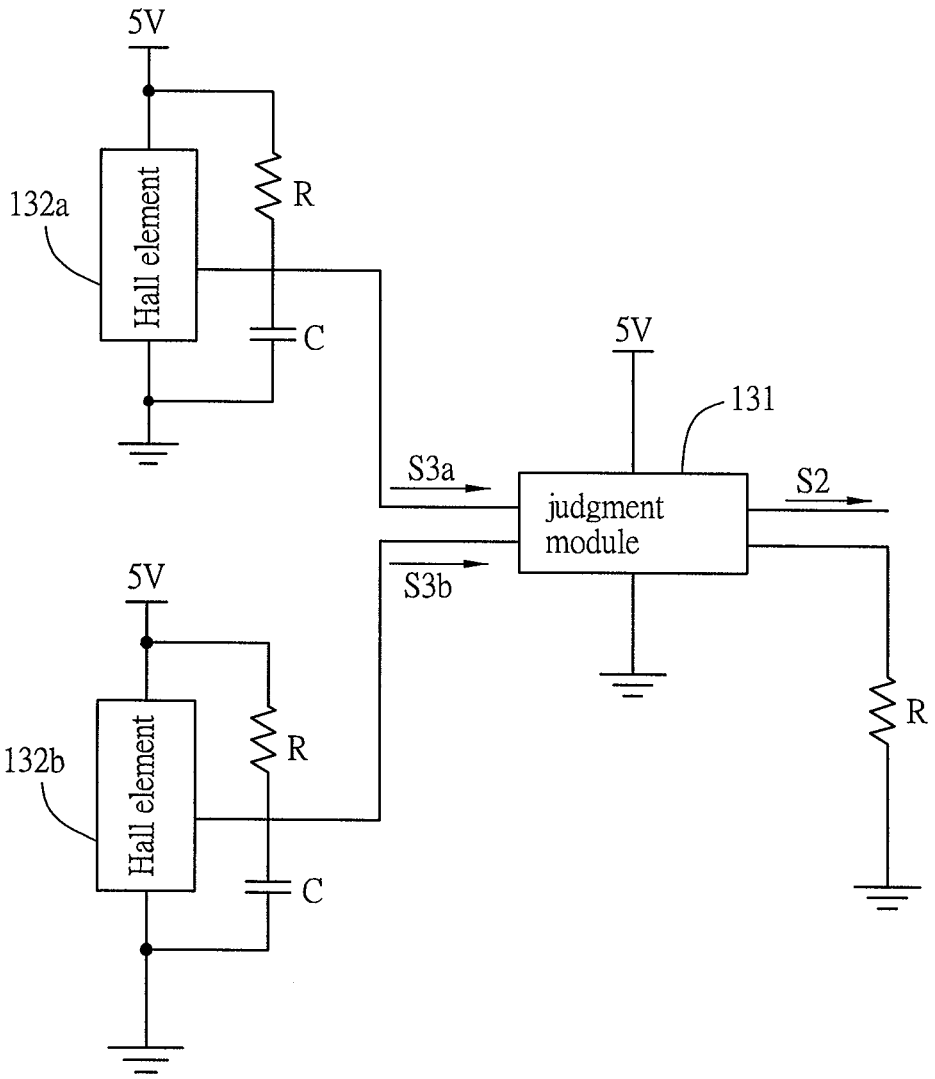
FIG. 5 is a circuit diagram of the rotation judgment circuit.

FIG. 4A is another schematic diagram of the Hall element and the rotor, and FIG. 4B is a schematic diagram of the signal waveform of the sensing signal and the judgment signal during the reverse rotation of the motor. As shown in FIGS. 4A and 4B, when the rotor rotates along the arrowhead direction (counterclockwise direction, i.e. the reverse direction), the N pole will sequentially pass through the Hall elements 132*b* and 132*a*. At the time Ta that the Hall element 132*a* senses the N pole to output the high-level signal, the sensing signal S3*b* is a high-level signal since the Hall element 132*b* has sensed the N pole to output the sensing signal S3*b*. According to the truth table in FIG. 3, the judgment signal S2 outputted by the judgment module 131 is a high-level signal. Accordingly, the judgment module 131 outputs the judgment signal S2 to the driving control circuit 12 to execute a braking. Moreover, the judgment module 131 can be a logic circuit or a microprocessor in consideration of the cooperation with the Hall element to determine the rotational direction. For example, the rotation judgment circuit 13 can be embodied in the circuit shown in FIG. 5, wherein each of the Hall elements 132*a*, 132*b* is connected to the resistor R and the capacitor C in series and connected to the judgment module 131 in parallel. Besides, the driving voltage of this embodiment is 5V, but this invention is not limited thereto.

Although some of the fans using a three-phase motor don't include a Hall element, the variation of the rotational direction still can be determined For example, a terminal voltage comparison estimation method, a third harmonic method, or a free-wheeling diode enabling estimation method can be used to determine if the rotational direction is reverse or not for executing the subsequent electromagnetic braking.

Figure 6:
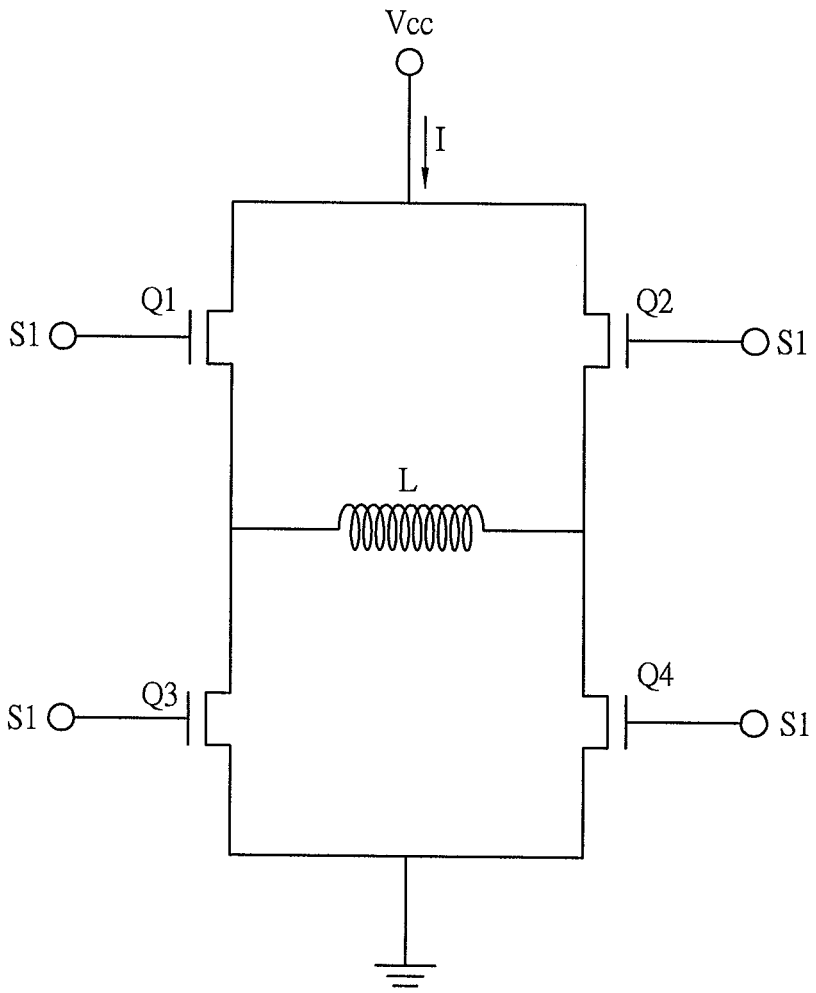
FIG. 6 is a schematic diagram of a part of the driving control circuit.
Figure 7A:
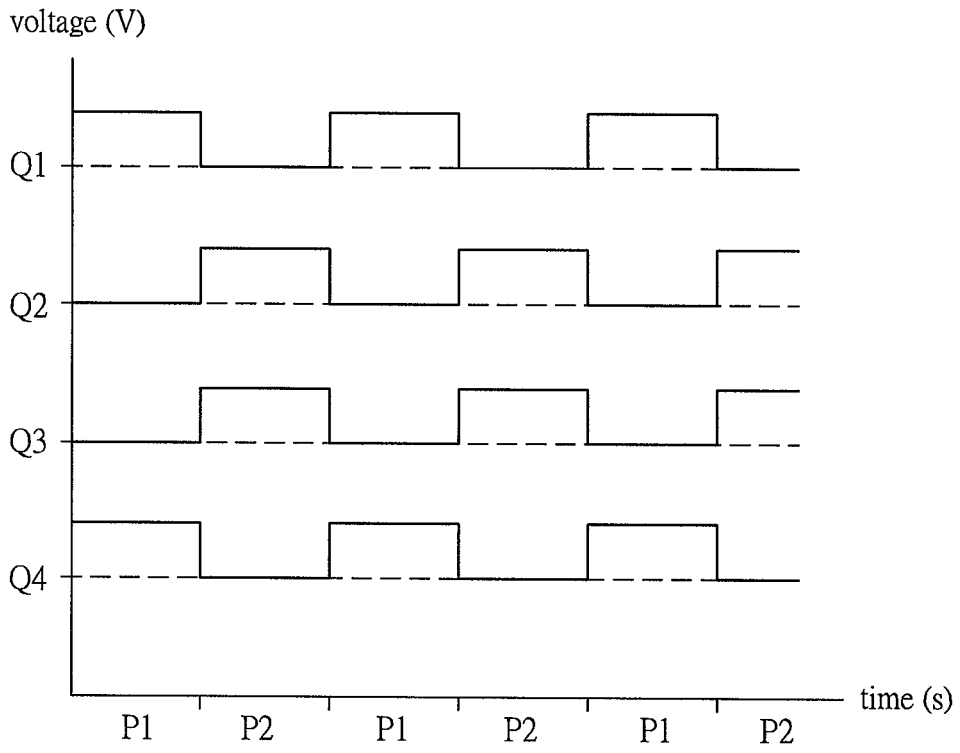
FIG. 7A is a schematic diagram of the driving signal.

FIG. 6 is a schematic diagram of a part of the driving control circuit 12. As shown in FIG. 6, the driving circuit of the motor 11 is generally embodied in a bridge circuit, such as a half-bridge circuit or a full-bridge circuit. The full-bridge circuit is taken as an example in this embodiment, but this invention is not limited thereto. The full-bridge circuit includes four switches Q1, Q2, Q3, Q4. During the operation of the motor 11, the variation of the magnetic poles of the coil L is caused by the driving signal S1 enabling the corresponding switches at different times. For example, the switches Q1, Q4 are enabled by the driving signal S1 in a first operation period P1, the switches Q2, Q3 are enabled by the driving signal S1 in a second operation period P2, and the first operation period P1 and the second operation period P2 occur alternately, which is shown in FIG. 7A, a schematic diagram of the driving signal.

Figure 7B:
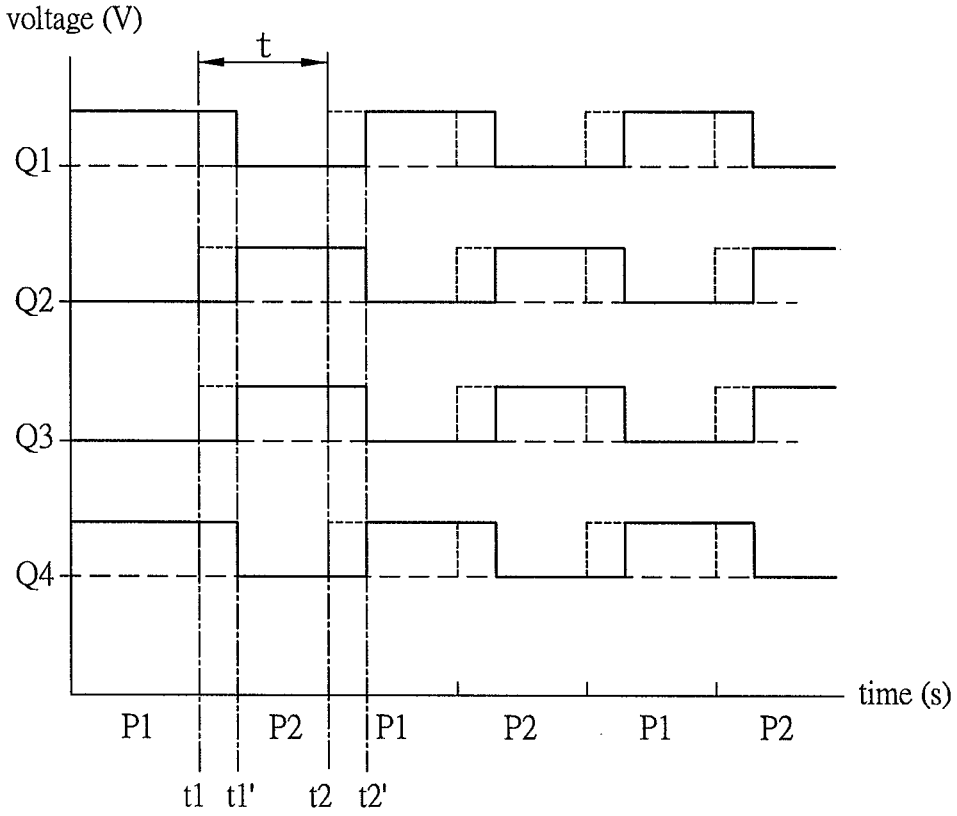
FIG. 7B is a schematic diagram of a delayed driving signal.

FIG. 7B is a schematic diagram of a delayed driving signal. As shown in FIGS. 7A, 7B, in this embodiment, the driving control circuit 12 delays the driving signal S1 according to the judgment signal S2 to execute the electromagnetic braking. During the first operation period P1, the driving signal S1 enables the switches Q1, Q4 to keep the operation of the motor 11. Since the motor 11 is in the state of reverse rotation, the driving signal S1 will enable the switches Q1, Q4 later so that the motor 11 can be slowed down due to the delay motion when the first operation period P1 starts. During the second operation period P2, the switches Q2 and Q3 are enabled at a start time t1 and are disenabled at an end time t2, and the time difference t between the start time t1 and the end time t2 is 0.5 second for example. In the delay case, the start time is delayed to the time t1' and the end time is delayed to the time t2', and the time difference between the time t1' and t2' is still kept the t value. Likewise, the first operation period P1 has the same delay order, and therefore will not be described here for conciseness. In other words, the driving control circuit 12 outputs the driving signal S1 later according to the judgment signal S2 to execute the electromagnetic braking. To be noted, if the delayed start time t1' coincides with the original end time t2, it can be considered that a reverse driving signal is inputted.

In this embodiment, the delayed start time t1' is between the original start time t1 and the original end time t2 for example. Herein, the reversely rotated motor 11 will be slowed down to the rotational speed of 0 due to the electromagnetic braking caused by the delayed driving signal S1, and will be turned into a normal rotation and operation due to that the driving signal S1 still drives the motor 11.

In other embodiments, the electromagnetic braking also can be carried out by fixedly enabling the corresponding switches. In specific, when the motor 11 is in the normal operation, the driving signal S1 enables the corresponding switches in the different operation periods, and for example, enables the switches Q1, Q4 in the first operation period P1 and the switches Q2, Q3 in the second operation period P2. However, when the switches are fixedly enabled to provide the electromagnetic braking, one of the operation periods will be kept and won't be replaced by the other operation period. For example, the first operation period P1 is kept and the switches Q1, Q4 are enabled until the motor 11 is stopped, and then the normal operation will be resumed.

Moreover, the delay time is determined according to the rotational speed of the reverse rotation, and the rotational speed can be measured by the rotation judgment circuit 13. In detail, when the motor 11 rotates faster, the time Ta and Tb shown in FIG. 4B will be closer to each other, wherein the time Tb is the time that the Hall element 132*b* senses the N pole to output the high-level signal. Accordingly, the longer delay time can bring the greater power of the braking. Oppositely, when the motor 11 rotates slower, the time Ta and Tb will be farther away from each other. Moreover, the power of the braking also can be increased by increasing the current passing through the coil L.

Figure 8:
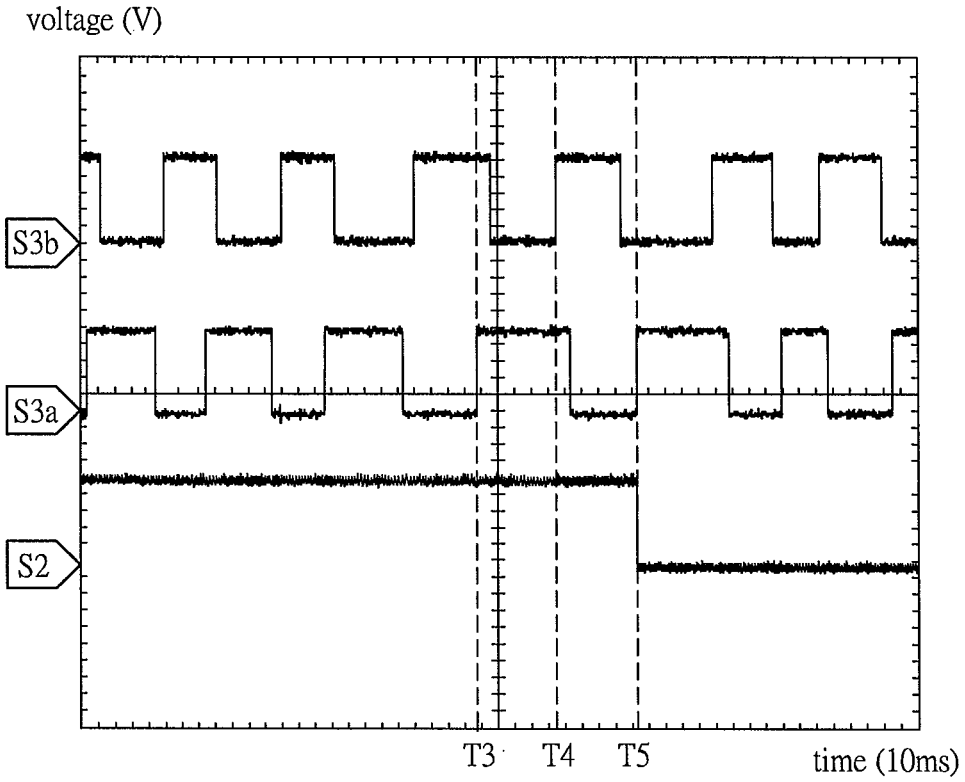
FIG. 8 is a schematic diagram of the signal waveform of the sensing signal and the judgment signal when the motor is turned into the normal rotation from the reverse rotation.

FIG. 8 is a schematic diagram of the signal waveform of the sensing signal and the judgment signal when the motor is turned into the normal rotation from the reverse rotation. In this embodiment, when the motor 11 is turned into the normal rotation from the reverse rotation due to the electromagnetic braking, the variations of the sensing signal S3 and the judgment signal S2 are shown in FIG. 8, wherein the time T3 is in relation to the reverse rotation, the time T4 is in relation to the normal rotation, and the period from the time T3 to the time T4 denotes the duration from the reverse rotation to the normal rotation. The time T5 is the time when the rotation judgment circuit 13 detects the motor 11.

Figure 9:
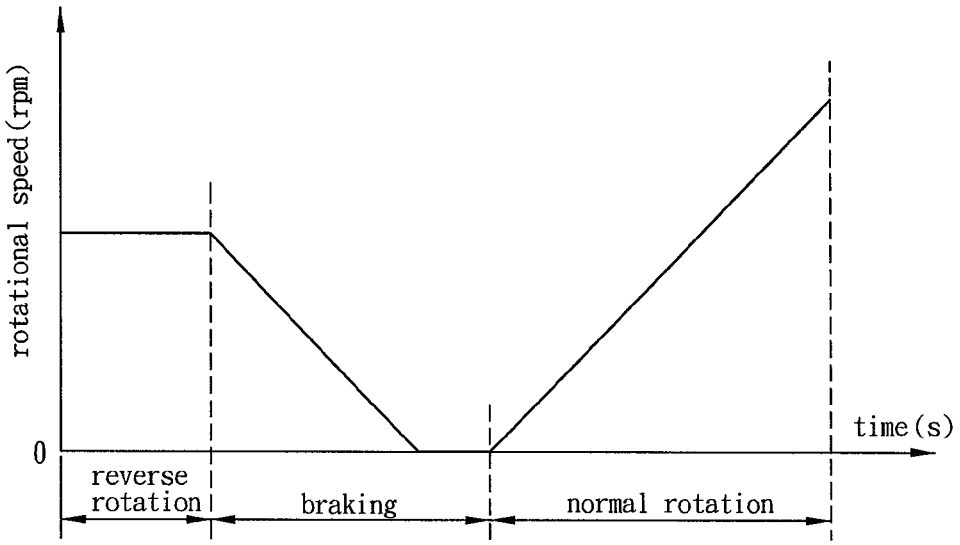
FIG. 9 is a schematic diagram of the variation of the rotational speed of the motor.

FIG. 9 is a schematic diagram of the variation of the rotational speed of the motor. As shown in FIG. 9, when the fan is in the reverse rotation due to the return air, the motor 11 is slowed down by the electromagnetic braking to be forced into a stop state and then turned into the normal rotation with an increased rotational speed. The strengths of the return air and the electromagnetic braking will both affect the duration of the stop state of the motor 11. For example, when the strength of the return air is weaker while the strength of the electromagnetic braking is stronger, the duration of the stop state is shorter.

Figure 10:
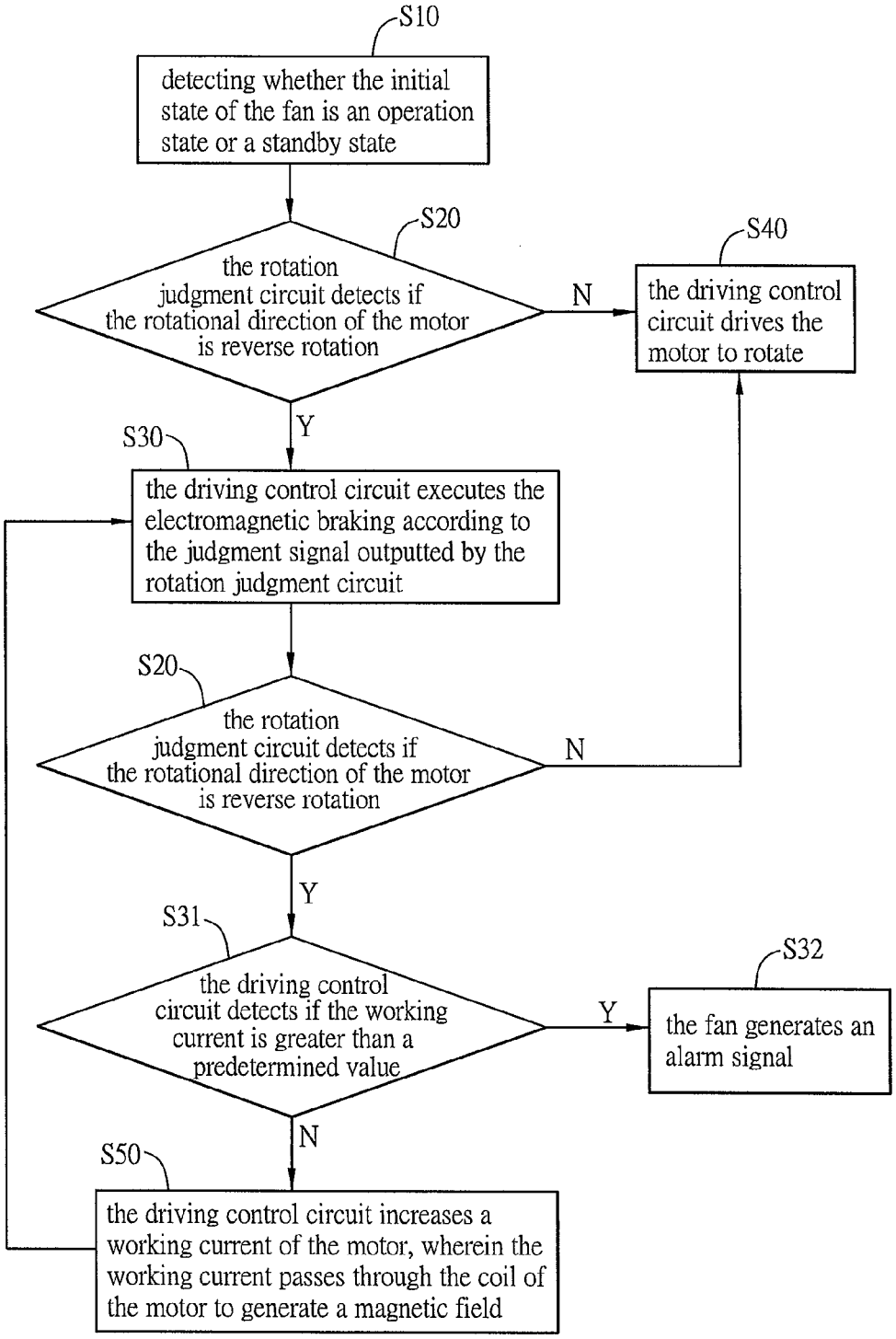
FIG. 10 is a flowchart of an anti-air-return method of the fan according to an embodiment of the invention.

FIG. 10 is a flowchart of an anti-air-return method of the fan according to an embodiment of the invention. As shown in FIG. 10, in this embodiment, the anti-air-return method is in cooperation with the anti-air-return fan system 1 of the above embodiment, which is not described here for conciseness since it can be comprehended by referring to the above embodiment. At the step S10, the initial state of the anti-air-return fan system 1 is an operation state or a standby state. In other words, the motor 11 is electrified or in operation. Then, at the step S20, the rotation judgment circuit 13 detects if the rotational direction of the motor 11 is reverse. When the rotational direction of the motor 11 is reverse, the step S30 is executed so that the driving control circuit 12 executes the electromagnetic braking according to the judgment signal S2 outputted by the rotation judgment circuit 13. When the rotational direction of the motor 11 is not reverse, e.g. a stop state or normal rotation, the step S40 is executed that the driving control circuit 12 drives the motor 11 to rotate. The electromagnetic braking can be carried out by the driving control circuit 12 delaying the driving signal S1 according to the judgment signal S2 or by fixedly enabling the corresponding switches, which can be comprehended by referring to the above embodiment and is therefore omitted here.

The rotation judgment circuit 13 continuously judges the rotational direction of the motor 11 at the step S20 as shown in FIG. 6 to detect the rotational direction of the motor 11 in real time. Hence, if the rotation judgment circuit 13 detects that the motor 11 is still in reverse rotation after executing the electromagnetic braking, the step S50 can be executed so that the driving control circuit 12 increases a working current I of the motor 11. The working current I passes through the coil L of the motor 11 to generate a magnetic field. Further, when the working current I is greater, the magnetic force caused by passing through the coil L is larger so that the strength of the braking can be increased and the duration of the reverse rotation of the motor 11 can be reduced.

Moreover, the steps S31 and S32 can be further included before increasing the working current I. At the step S31, the driving control circuit 12 detects if the working current I is greater than a predetermined value. In this embodiment, if the return air is too strong, the working current I will be further increased so as to increase the power of the electromagnetic braking. However, if the working current I is overhigh, the motor 11 is easily damaged. Hence, by setting the predetermined value, if the working current I is greater than the predetermined value, it indicates that the return air condition can't be overcome by the electromagnetic braking. Therefore, the step S32 is executed that the anti-air-return fan system 1 generates an alarm signal to inform the user that the motor 11 is still in the reverse rotation.

In the anti-air-return system and method of the fan according to the invention, the rotation judgment circuit detects if the motor is in the reverse rotation. When the motor is in the reverse rotation, the rotation judgment circuit makes the driving control circuit execute the braking so that the motor can be turned into the normal rotation for a smooth operation.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An anti-air-return fan system, comprising:

a motor;

a driving control circuit electrically connected to the motor, having a driving signal and driving the motor to rotate according to the driving signal; and a rotation judgment circuit outputting a judgment signal to the driving control circuit when detecting that the motor reversely rotates, wherein the rotation judgment circuit comprises:

a judgment module; and at least two Hall elements electrically connected to the judgment module in parallel, wherein each of the Hall elements has a first terminal, a second terminal, and a third terminal, the first terminal is connected to a first end of a resistor, the second terminal is connected to a first end of a capacitor and grounded, the third terminal is connected to a second end of the resistor, a second end of the capacitor, and an input terminal of the judgment module, wherein each of the Hall elements outputs a sensing signal to the judgment module according to the rotation of the motor, and the judgment module outputs the judgment signal to the driving control circuit according to the sensing signals, and wherein the driving control circuit executes a braking according to the judgment signal, and the driving control circuit drives the motor to operate when the rotation judgment circuit detects that the motor doesn't rotate reversely.

2. The anti-air-return fan system as recited in claim 1, wherein the driving control circuit executes the braking by fixedly enabling a corresponding switch according to the judgment signal.

3. The anti-air-return fan system as recited in claim 2, wherein the driving control circuit delays the driving signal according to the judgment signal to execute the braking.

4. The anti-air-return fan system as recited in claim 1, wherein the driving control circuit is a half-bridge circuit or a full-bridge circuit, and includes a plurality of switches.

5. The anti-air-return fan system as recited in claim 4, wherein the driving control circuit executes the braking by fixedly enabling the corresponding switches.

6. The anti-air-return fan system as recited in claim 1, wherein the judgment module is a logic circuit or a microprocessor.

7. The anti-air-return fan system as recited in claim 1, wherein the rotation judgment circuit detects if the rotational direction of the motor is reverse by a terminal voltage comparison estimation method, a third harmonic method, or a free-wheeling diode enabling estimation method.

8. An anti-air-return method of a fan including a motor, a rotation judgment circuit, and a driving control circuit having a driving signal and driving the motor to rotate according to the driving signal, the method comprising steps of:

detecting whether an initial state of the fan is an operation state or a standby state;

detecting if the rotational direction of the motor is reverse by the rotation judgment circuit;

executing a braking by the driving control circuit according to a judgment signal outputted by the rotation judgment circuit when the rotational direction of the motor is reverse; and driving the motor to rotate by the driving control circuit when the rotational direction of the motor is not reverse, wherein the rotation judgment circuit comprises:

a judgment module; and at least two Hall elements electrically connected to the judgment module in parallel, wherein each of the Hall elements has a first terminal, a second terminal, and a third terminal, the first terminal is connected to a first end of a resistor, the second terminal is connected to a first end of a capacitor and grounded, the third terminal is connected to a second end of the resistor, a second end of the capacitor, and an input terminal of the judgment module, and wherein each of the Hall elements outputs a sensing signal to the judgment module according to the rotation of the motor, and the judgment module outputs the judgment signal to the driving control circuit according to the sensing signals.

9. The method as recited in claim 8, wherein the driving control circuit executes the braking by fixedly enabling a corresponding switch according to the judgment signal.

10. The method as recited in claim 8, wherein the driving control circuit delays the driving signal according to the judgment signal to execute the braking.

11. The method as recited in claim 8, wherein after executing the braking, the method further comprises a step of:

increasing a working current of the motor if the rotation judgment circuit detects that the motor is still in reverse rotation, wherein the working current passes through a coil of the motor to generate a magnetic field.

12. The method as recited in claim 11, wherein before increasing the working current, the method further comprises steps of:

detecting if the working current is greater than a predetermined value by the driving control circuit; and generating an alarm signal by the fan if the working current is greater than the predetermined value.

13. The method as recited in claim 8, wherein the judgment module is a logic circuit or a microprocessor.

* * * * *